United States Patent [19]

Pozzobon

[11] Patent Number: 5,046,269

[45] Date of Patent: Sep. 10, 1991

[54] DEVICE FOR ADJUSTING THE FLEXIBILITY IN A SKI BOOT

[75] Inventor: Alessandro Pozzobon, Paderno di Ponzano Veneto, Italy

[73] Assignee: Nordica S.p.A., Montebelluna TV, Italy

[21] Appl. No.: 161,635

[22] Filed: Feb. 29, 1988

[30] Foreign Application Priority Data

Mar. 6, 1987 [IT] Italy ..... 82516 A/87

[51] Int. Cl.[5] ..... A43B 5/04

[52] U.S. Cl. ..... 36/120; 36/121

[58] Field of Search ..... 36/117–121

[56] References Cited

U.S. PATENT DOCUMENTS 4,667,424 5/1987 Sartor et al. ..... 36/120
4,709,491 12/1987 Morell et al. ..... 36/121
4,733,484 3/1988 Delery ..... 36/120

FOREIGN PATENT DOCUMENTS 217423 4/1987 European Pat. Off. ..... 36/117
252417 1/1988 European Pat. Off. ..... 36/117
2557776 7/1985 France ..... 36/117

*Primary Examiner*—James Kee Chi
*Attorney, Agent, or Firm*—Guido Modiano; Albert Josif

[57] ABSTRACT

The device comprises at least one interference element slideably associated laterally to said at least one front quarter. Said interference element selectively interacts with one or more separate contrast elements rigidly associated with, and protruding from, said shell. The device furthermore comprises means provided for locking said at least one interference element in a desired position.

11 Claims, 1 Drawing Sheet

DEVICE FOR ADJUSTING THE FLEXIBILITY IN A SKI BOOT

BACKGROUND OF THE INVENTION

The present invention relates to a device for adjusting the flexibility in a ski boot.

Various devices are currently known applied to boots and used to adjust the flexibility of a quarter with respect to the shell.

In U.S. Pat. No. 4,667,424, Sartor et al, assigned to the same Assignee of the present application, and assumed included herein as reference, a device is claimed the peculiarity whereof resides in the fact that an interference element is provided, constituted by a wedge-like body which acts between the shell and the front tip, at the region of the instep of the foot.

Means for the adjustment of its position with respect to the longitudinal axis of the shell are associated with said wedge-like body.

Said means allow to adjust the contrast and the movement of said front quarter with respect to the shell.

Though said device allows a good flexibility, it is structurally very complicated with regard to its application the boot.

The adjustment of the device furthermore requires successive settings before achieving the desired degree of flexibility, there being no separate positions univocally determining said degree; this condition forces the skier to execute multiple forward flexings, making this adjustment uncomfortable in use.

Published French Patent Applications No. 2480575 and No. 2564710 disclose ski boots having devices for adjusting the quarter flexibility. Although these devices allow a rather satisfactory adjusting of the flexibility they have quite a complex and costly structure; the adjusting operation being furthermore sometimes difficult and long.

Also U.S. Pat. No. 4,095,356 discloses a ski boot having a flex adjusting possibility of the quarters obtained by means of a complex structure. All these ski boots have the disadvantages of having a complicated structure which entails high manufacturing costs.

SUMMARY OF THE INVENTION

The aim of the present invention is therefore to eliminate the disadvantages described above in known types, by providing a device which allows a rapid, simple and easy adjustment of the flexibility of the front quarter with respect to the shell.

Within the scope of the above described aim, an important object is to provide a device which has the preceding characteristic without affecting the region of the instep of the foot of the skier.

Another object is to provide a device wherein the skier can adjust the flexibility at any moment.

Still another object is to provide a device which allows a wide degree of adjustment of the flexibility.

Not least object is to provide a device which is structurally simple and has good reliability in use.

The aim and the objects described above, as well as others which will become apparent hereinafter, are achieved by a device for adjusting the flexibility in a ski boot, comprising a shell whereto is associated at least one front quarter, characterized in that it comprises at least one interference element slideably associated laterally to said at least one front quarter and selectively interacting with one or more separate contrast elements rigidly associated and protruding from said shell, means being provided for locking said at least one interference element In a desired position.

BRIEF DESCRIPTION OF THE DRAWINGS

Further characteristics and advantages of the invention will become apparent from the detailed description of some embodiments, illustrated only by way of non-limitative examples in the accompanying drawings, wherein.

DESCRIPTION OF THE PREFERRED EMBODIMENTS

Figures 1, 2, 3, 4, 5, 6:
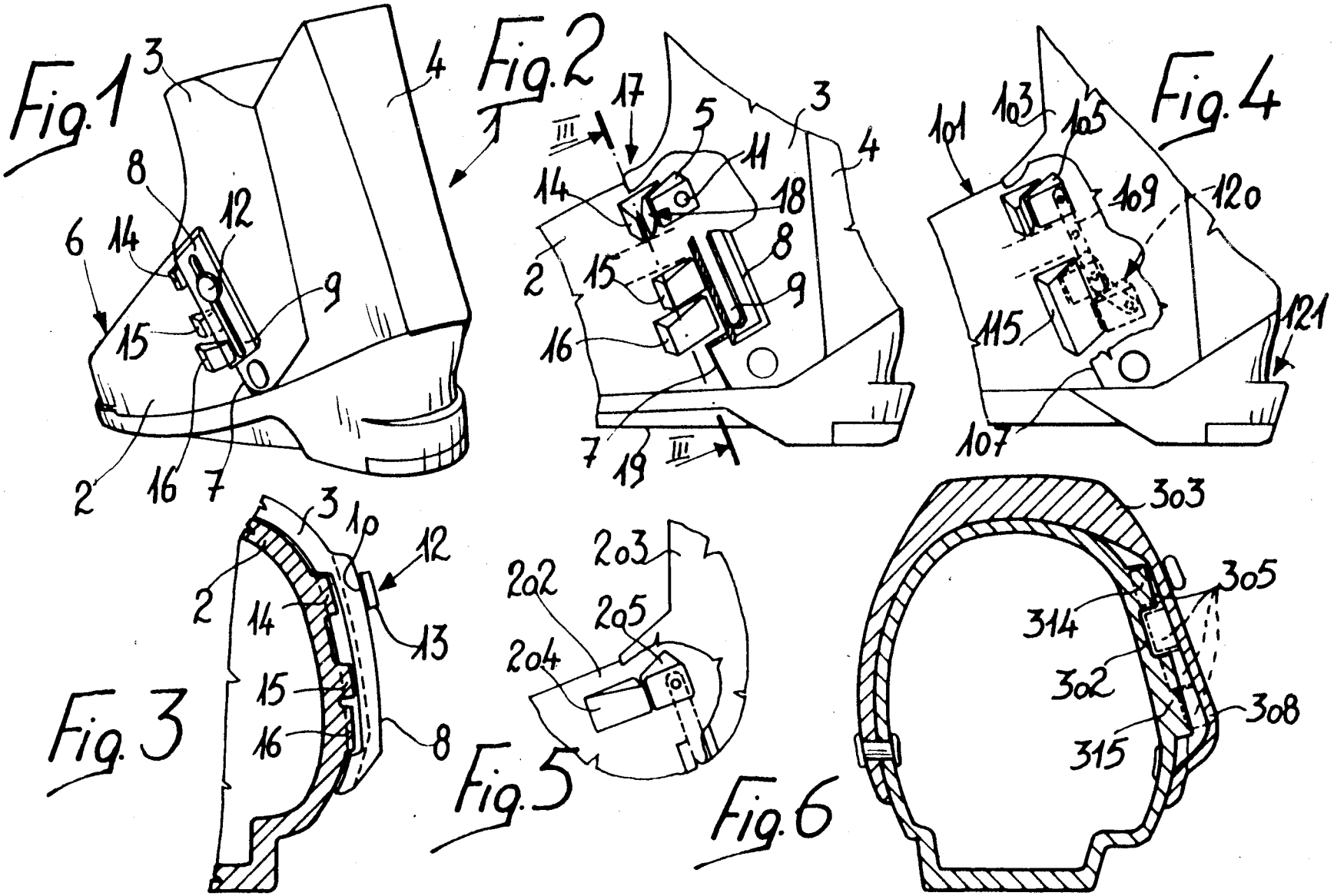
FIG. 1 is a perspective view of a boot according to the invention.
FIG. 2 is a partially sectioned side view of the boot, wherein for sake of clarity the interference element element is pointed out.
FIG. 3 is a view along the sectional plane III—III of FIG. 2.
FIG. 4 is a perspective view of a boot according to another aspect of the invention.
FIG. 5 is a side view of a detail of a boot according to a third aspect of the invention.
FIG. 6 is a view according to a sectional plane transverse to the shell passing at the contrast elements protruding from the shell of a boot according to a fourth aspect of the invention.

With reference to the above described figures, the device for adjusting the flexibility in a ski boot 1, comprising a shell 2 whereto are articulated a front quarter 3 and a rear quarter 4, comprises an adjustable interference element 5 preferably wedge-shaped with its tapered end directed towards the tip 6 of the boot 1.

Said adjustable interference element 5 is interposed between the shell 2 and the front quarter 3, on the latter there being provided, at the lateral region and proximate to the perimetral edge 7 of said front quarter 3, a guide 8 with which said element 5 is slideably associated.

Said guide 8 is arranged approximately parallel to the perimetral edge 7 and has a longitudinal slot 9, for a means for locking said interference element 5 to said guide.

Said locking means comprises a locking screw having a threaded stem 10 passing through at said slot 9 and associated with a complimentarily threaded seat 11 provided on the interference element 5, with said stem 10 there being rigidly associated a head 12 protruding from said slot 9 and having a lateral surface 13 knurled to provide a better grip for the user.

The greater or smaller rotation imparted to the head 12 allows to lock the adjustable interference element 5 at a selected point of the guide 8 or allows its free sliding with respect thereto and to the underlying shell 2.

Said interference element 5 interacts with three separate fixed interference elements constituted by a first, a second and a third lug, respectively indicated by the numerals 14, 15 and 16, rigidly associated and protruding from the shell 2 proximate to the perimetral edge 7 of the front quarter 3.

The first lug 14 is positioned proximate to the region 17 of the instep of the foot, and has an abutment 18 for the end directed towards the tip 6 of the adjustable Interference element 5, positionable thereat by moving the head 12 at the upper end of the slot 9.

Beyond the first lug 14, in the direction of the sole 19 of the boot i, a second lug 15 is provided at a distance from the first lug 14 at least equal to the width of the interference element 5.

Also the second lug 15 has a wedge-like shape with the tapered end directed towards the element 5.

Adjacent to the second lug 15 a third lug 16 is provided, having the same shape as the previous one, the two possibly having differentiated longitudinal extensions and/or an inclined surface interacting with the adjustable interference element 5 having different degrees of inclination.

This allows to obtain a different degree of flexibility for the quarter.

By acting on the head 12 the skier can determine with which lug 14,15 or 16 the interference element 5 can interact.

The operation is very easy, since the skier has to bend laterally and not forwards.

The interspace between the first lug 14 and the second lug 15 furthermore provided a condition of maximum flexibility.

It has thus been observed that the invention achieves the intended aim and objects, a device having been provided which besides allowing a rapid, simple and easy adjustment of the flexibility of the front quarter with respect to the shell allows to achieve a wide degree of adjustment of the flexibility, the device being furthermore structurally very simple and reliable in use.

Naturally the invention is susceptible to numerous modifications and variations, all within the scope of the same inventive concept.

Thus, for example, as illustrated in FIG. 4, the second and the third lug may be constituted by a singe lug 115, the variation of the degree of flexibility being achieved by using a slot 109 on the front quarter 103 which has a first portion approximately parallel to the perimetral edge 107 of the latter and, approximately at the midpoint of said lug 115, a portion 120 inclined in the direction of the heel 121 of the boot 101.

In this manner the interference element 105 is spaced, in a suitable and variable manner, from the surfaces with which it interacts with the lug 115.

As illustrated in FIG. 5, the first lug 204, if a locked effect, that is to say the lack of flexibility, is desired, may have, at the end of the adjustable interference element 205 directed towards the tip of the boot, an abutment shaped complimentarily thereto.

In this manner the front quarter 203 is prevented from having any relative movement with respect to the shell 202.

FIG. 6 partially illustrates a ski boot according to a further aspect of the invention, in which the guide 308 is arranged at a plane inclined with respect to that of arrangement of the underlying surface of the shell 302.

Supposing that said inclination causes the guide 308 to space itself further from the shell 302 at the lug 315, consequently upon a movement of the adjustable interference element 305 from the first lug 314 to the lug 315 a progressive increase of the distance between the surfaces of interaction between said lugs and said adjustable interference element is imposed.

This allows therefore to vary the degree of flexibility of the front quarter 303 with respect to the shell 302.

Naturally the means for locking said interference element may be the most suitable according to the specific requirements, for example it can be constituted by a threaded stem at its end protruding out of the guide there being associated a small knob provided with an eccentric element and interacting with an adapted toothing provided on the front quarter.

The number of contrast elements, as well as their arrangement and the degree of inclination of the surface interacting with the interference element may also be the most suitable according to the specific requirements.

The materials and the dimensions of the individual components of the device may also be any according to the specific requirements.

I claim:

1. In a ski boot including a substantially rigid elongate shell with a toe portion, a heel portion and a sole, a semirigid front quarter with an upper and a lower portion, a pivotal connection between said front quarter and said shell to allow forward flexion of the lower leg of the skier in use, said lower portion of said front quarter having a forward peripheral edge extending transverse to the longitudinal direction of said shell, a device for adjusting the flexibility of said ski boot at said pivotal connection, said device comprising at least one fixed interference element located on said shell to project from the outer surface thereof and at least one adjustable interference element arranged on said front quarter, guide means being located on said shell for slidably guiding said at least one adjustable interference element, releasable locking means being associated with said adjustable interference element to selectively lock said adjustable interference element on said guide means, wherein said guide means extend over one lateral region of said lower portion of said quarter proximately to said forward peripheral edge thereof, said adjustable interference element being movable along said guide means between an inoperable position in which said adjustable interference element is not engageable with said fixed interference element and at least one operable position in which said adjustable interference element is frictionally and at least partially resiliently engageable with said at least one fixed interference element upon forward flexion of said front quarter, to thereby selectively adjust the flexibility of the ski boot.

2. Device according to claim 1, wherein said adjustable interference element is substantially wedge-shaped with its tapered end directed towards said toe portion of said shell.

3. Device according to claim 1, wherein said guide means comprise a slot arranged on said lateral region of said lower portion of said front quarter and extending at least partially substantially parallel to said forward edge thereof.

4. Device according to claim 1, wherein said adjustable interference element is substantially wedge-shaped with its tapered end directed towards said toe portion of said shell, and wherein said guide means comprise a slot arranged on said lateral region of said lower portion of said front quarter and extending at least partially substantially parallel to said forward edge thereof, wherein said locking means comprise a threaded seat formed on said wedge-like element and a locking screw having a complementary threaded stem, said threaded stem passing through said slot to threadably engage with said threaded seat to stably dispose said wedge-like on said front quarter, said locking screw having a peripherally knurled enlarged head protruding outwardly of said front quarter for being gripped by a skier.

5. Device according to claim 1, wherein said fixed interference element comprises one first, one second and one third lug.

6. Device according to claim 1, wherein said fixed interference element comprises one first, one second and one third lug, and wherein said first lug is located on said front quarter proximate to the instep portion of the skier's foot, said first lug having an abutment rear portion for stopping the forward tapered end of said adjustable interference element.

7. Device according to claim 6, wherein said abutment portion of said first lug is complementary shaped with respect to said tapered forward end of said adjustable interference element.

8. Device according to claim 6, wherein said second lug is spaced from said first lug in a direction towards the sole of the boot by a distance at least equal to the width of said adjustable interference element, said second lug being substantially wedge-shaped with its tapered end directed towards the heel portion of the shell.

9. Device according to claim 6, wherein said third lug is adjacent to said second lug and has a wedge-like shape with a different width and inclination angle from said second lug.

10. Device according to claim 1, wherein said adjustable interference element is substantially wedge-shaped with its tapered end directed towards said toe portion of said shell, and wherein said guide means comprise a slot arranged on said lateral region of said lower portion of said front quarter and extending at least partially substantially parallel to said forward edge thereof, wherein said locking means comprise a threaded seat formed on said wedge-like element and a locking screw having a complementary threaded stem, said threaded stem passing through said slot to threadably engage with said threaded seat to stably dispose said wedge-like on said front quarter, said locking screw having a peripherally knurled enlarged head protruding outwardly of said front quarter for being gripped by a skier, wherein said fixed interference element comprises one first, one second and one third lug, wherein said second and said third lugs are unitary formed to define a single fixed interference element, said slot including a first portion substantially parallel to said forward peripheral edge of said quarter and a second portion connected with said first portion and inclined with respect thereto approximately towards said hell portion of said shell.

11. Device according to claim 1, wherein said guide means comprise a slot extending in an inclined plane with respect to the plane in which said at least one fixed interference element is arranged, the distance of said slot from the underlying surface of the shell progressively increasing towards the sole of the boot.

* * * * *